US005392984A

United States Patent [19]

Yocum

[11] Patent Number: 5,392,984

[45] Date of Patent: Feb. 28, 1995

[54] CARTON WITH REINFORCED HANDLE

[75] Inventor: James A. Yocum, West Chester, Pa.

[73] Assignee: Dopaco, Inc., Downingtown, Pa.

[21] Appl. No.: 193,466

[22] Filed: Feb. 8, 1994

[51] Int. Cl.[6] ..... B65D 5/46

[52] U.S. Cl. ..... 229/117.15; 229/117.14

[58] Field of Search ..... 229/117.13, 117.14, 229/117.15; 206/162–166, 170–191

[56] References Cited

U.S. PATENT DOCUMENTS

| | | | |
|---|---|---|---|
| 2,066,753 | 1/1935 | Weiss . | |
| 2,372,351 | 3/1945 | Arneson | 206/180 |
| 2,513,079 | 8/1949 | Buerger . | |
| 2,565,449 | 8/1951 | Emrick | 206/170 |
| 2,596,087 | 5/1952 | Shoudy . | |
| 2,881,946 | 4/1959 | Bosrock et al. | 206/171 |
| 2,933,232 | 4/1960 | Bugnone | 229/117.14 |
| 3,166,235 | 4/1964 | Schroeder . | |
| 3,591,070 | 7/1971 | Vrana | 229/117.15 |
| 4,307,834 | 12/1981 | Roccaforte . | |
| 4,341,341 | 7/1981 | Racaforte . | |
| 4,610,349 | 9/1986 | Schwartz et al. | 206/163 |
| 4,678,079 | 7/1987 | Henning | 229/117.14 |

FOREIGN PATENT DOCUMENTS

| | | | |
|---|---|---|---|
| 1038834 | 9/1978 | Canada | 229/117.15 |
| 1189297 | 10/1959 | France | 229/117.14 |
| 627350 | 10/1961 | Italy | 229/117.14 |
| 729135 | 12/1966 | Italy | 229/117.14 |
| 314627 | 9/1969 | Sweden | 229/117.14 |

*Primary Examiner*—Gary E. Elkins

*Attorney, Agent, or Firm*—Dennison, Meserole, Pollack & Scheiner

[57] ABSTRACT

A carton structure with opposed side walls and opposed end walls interconnected by fold lines. Foldable closure panels are integrally joined to the upper edges of the side walls, and in turn have foldable handle panels integral with the outer edges thereof. A reinforcement panel is integral with one end of each handle panel and folds thereover to lie between the handle panels. End panels extend from the upper edges of the end walls with the reinforcement panels being positioned immediately outward of the end panels. The end panels fold to interlock with the folded handle and reinforcement panels.

15 Claims, 5 Drawing Sheets

CARTON WITH REINFORCED HANDLE

BACKGROUND OF THE INVENTION

The invention is principally concerned with a carton for fast food and the like, with the carton folded from paperboard to define an integral locked closure and handle assembly, and in particular a carton wherein the handle is formed from dual handle panels integral with the sides of the carton and interlocked by extensions of the end walls of the carton. The handle panels are provided with elongate slots or openings therethrough which, when assembled, define a hand hole.

Such cartons have been found to be highly effective. However, in the larger size cartons, for example those intended to receive whole or multiple pieces of fried chicken, the cartons tend to be weak in the handle area with the hand grip, that portion of the handle overlying the elongate hand hole, comprising only the two thicknesses of the handle panels, having a tendency to tear, generally toward the opposed ends of the hand hole.

The original carton as formed, noting the prior art blank of FIG. 7, has been designed to first of all achieve the desired configuration of formed carton, and second of all to minimize the amount of material used and the scrap materials left behind. This is significant in reducing the overall costs in light of the vast number of such throw-away cartons that are produced. Nevertheless, depending upon the particular design desired, some scrap area inevitably results. For example, in the described carton, two significant scrap areas appear both between the two handle panels of the blank and to the opposite or outer side of one of the handle panels.

SUMMARY OF THE INVENTION

It is the object of the present invention to provide a carton, of the type described above, with a reinforced handle, thus greatly enhancing its ability to carry heavier loads, be formed in larger sizes, have greater stability, etc.

It is also a significant object of the invention to provide reinforcement of the handle utilizing dual reinforcement panels specifically formed from the area heretofore considered as scrap. In this manner, no additional costs for material is involved, and in fact, as the amount of scrap to be removed and recycled, or otherwise disposed of, is reduced, it is conceivable the improved carton might also have economic advantages.

The assembled closure and handle, while significantly strengthened by the reinforcement, has little difference in appearance.

The carton of the invention includes a bottom formed by overlapping and interengaging bottom panels, opposed elongate side walls, and relatively narrower end walls. A pair of closure panels are folded from the upper edges of the side walls and in turn have handle panels folded from the upper or outer edges thereof to parallel each other and project upwardly from the folded closure panels. The handle panels have elongate hand holes therein, each formed by a pivoting flap which fold to the same side and provide a smooth gripping edge and a relatively thicker grip.

The end walls include end panels integral with the upper edges thereof which fold into locking components which engage projections on the opposed ends of the formed handle. Each of these end panels has a reinforcement panel of the invention formed immediately thereover, in the area heretofore comprising scrap, and separated from the upper edge of the end panel by a cut line. Each of the reinforcement panels is secured to the side or vertical edge of one of the handle panels, each to the corresponding end of the corresponding handle panel, that is either to the right edge thereof or the left edge thereof depending upon a viewing of the blank.

Each reinforcement panel folds along the secured edge to lie against the inner face of the corresponding handle panel, preferably overlapping to at least midway or further. Each of the reinforcement panels further includes a partial hand opening or elongate slot defined therein and opening through the free side edge thereof to overlie and correspond to aperture through the corresponding handle panel and the finally formed hand hole through the handle itself. The slot in each reinforcement panel is at approximately mid-height whereby the reinforcement panel forms both a portion of the final hand grip as well as a portion of the area of the handle which both underlies the hand hole and extends along the side thereof, this latter portion generally being an area of weakness.

Thus folded and formed, the reinforcement panels enhance the strength of the handle by at least 50 percent in a unique and distinctive manner.

Other features, objects and advantages of the invention will become apparent from the detailed description of the invention following hereinafter.

DESCRIPTION OF THE PREFERRED EMBODIMENT

Figure 1:
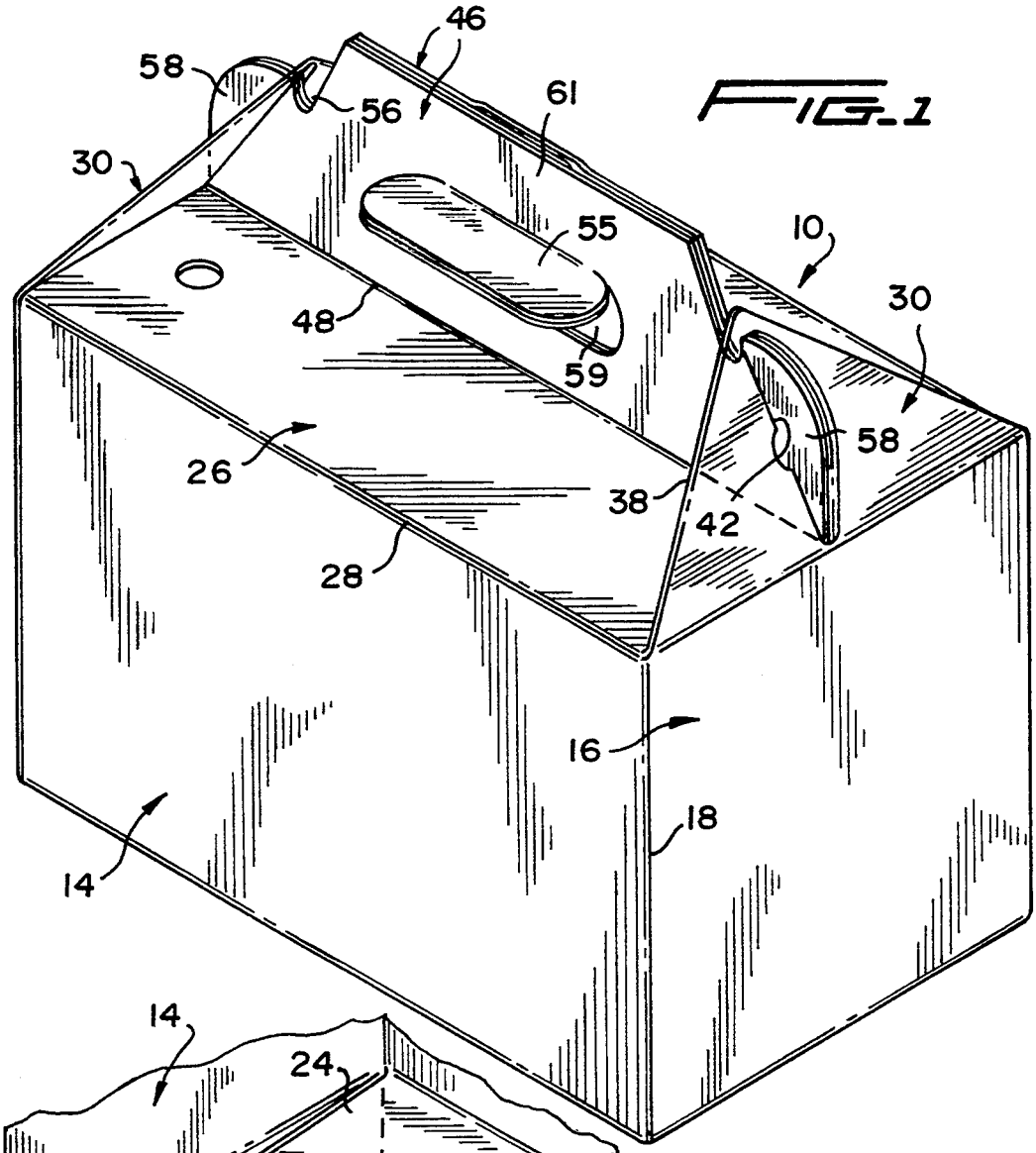
FIG. 1 is a perspective view of the closed carton of the invention.
Figure 2:
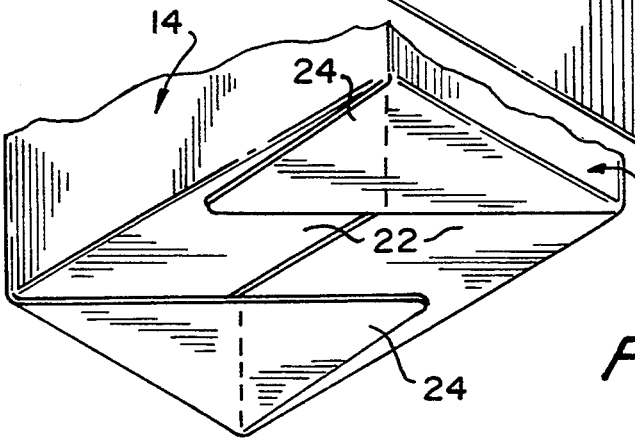
FIG. 2 is a partial perspective view illustrating the bottom of the carton.
Figure 3:
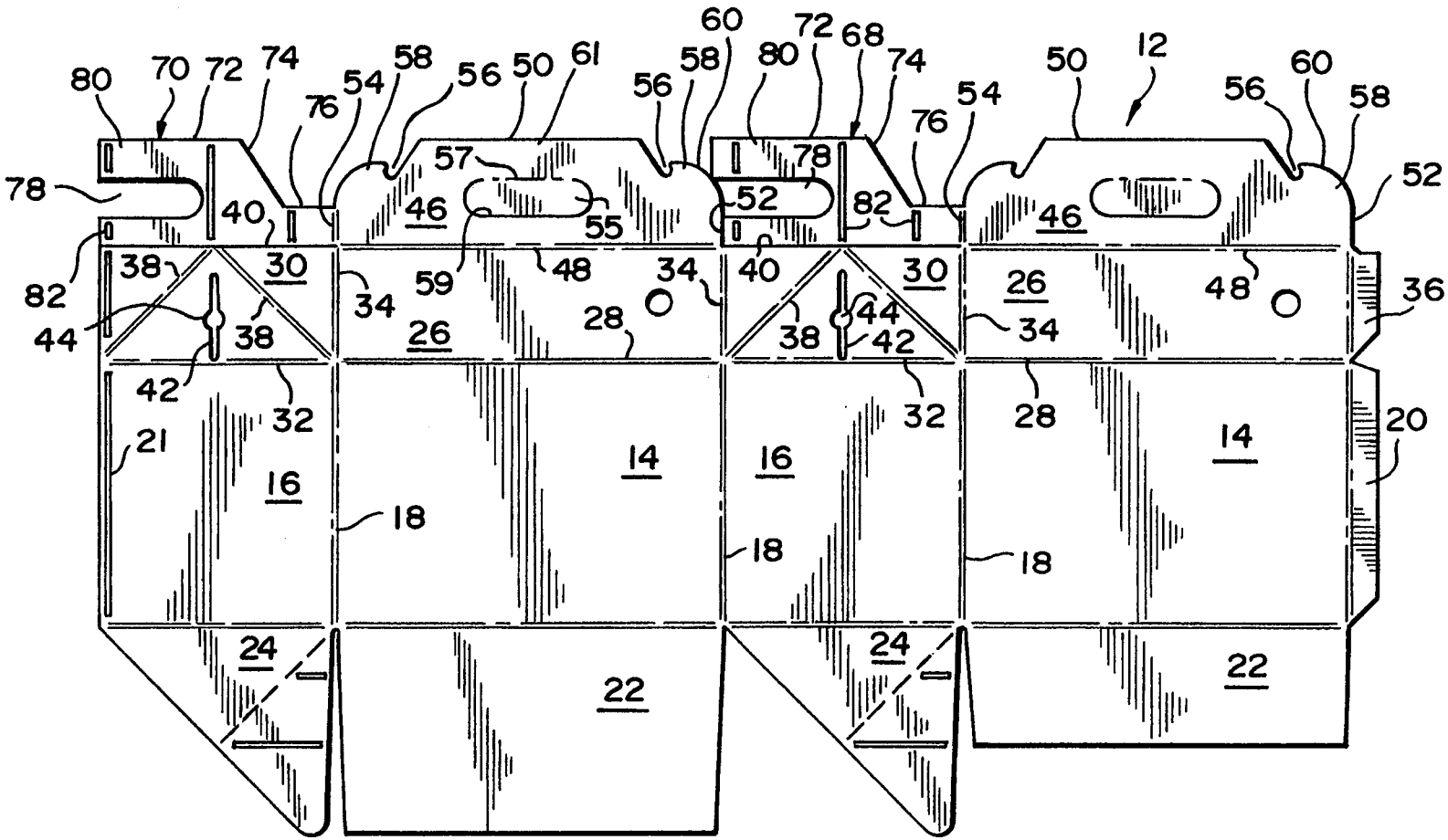
FIG. 3 is a plan view of the blank from which the carton is formed.
Figure 4:
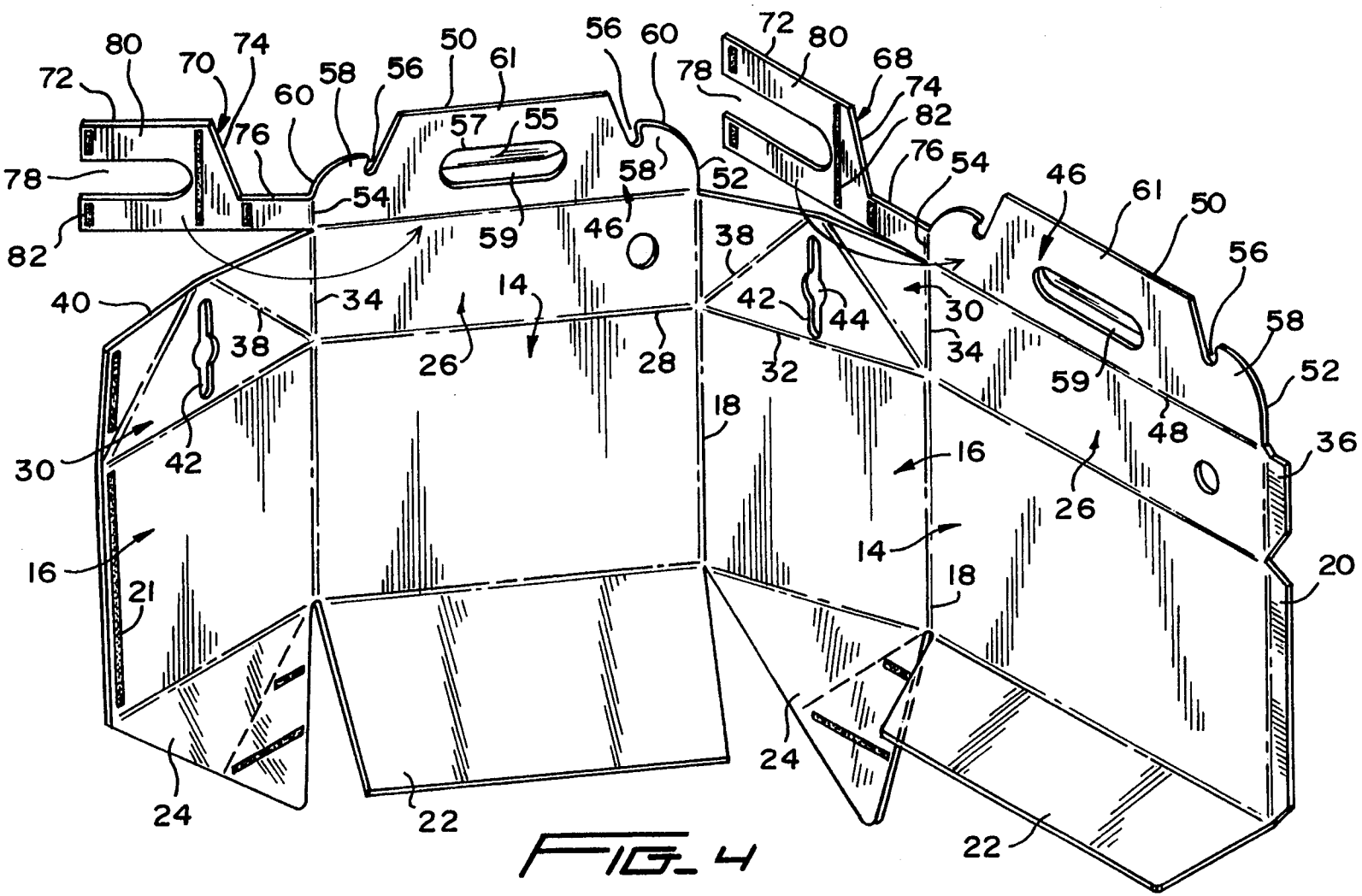
FIG. 4 illustrates an initial step in folding the carton and positioning the reinforcement panels.
Figure 6:
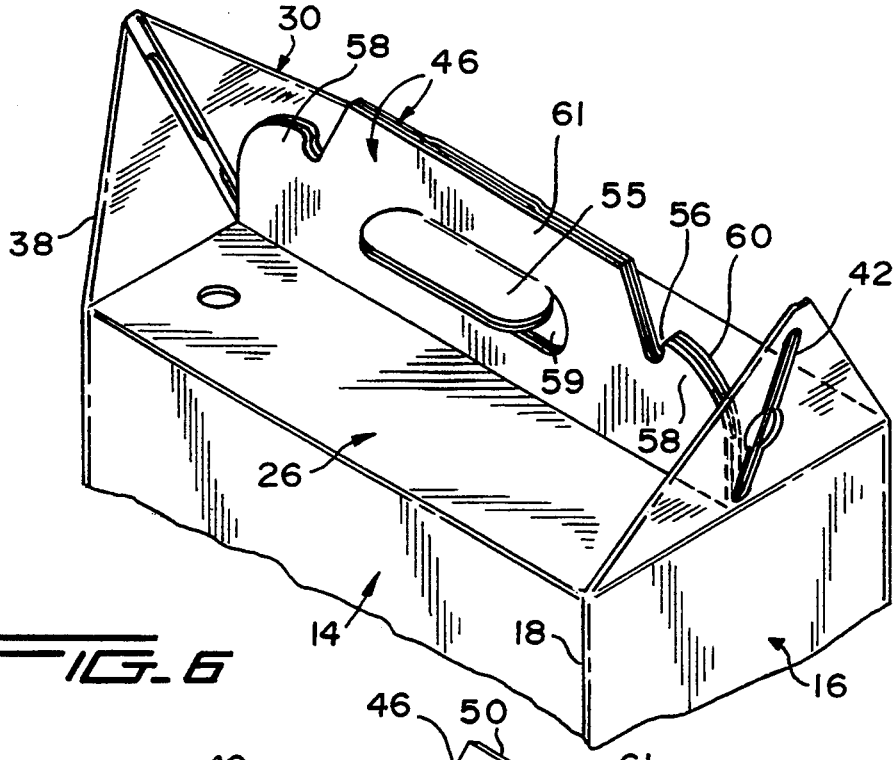
FIG. 6 illustrates a further step in closing the carton to arrive at the closed carton of FIG. 1.
Figure 5:
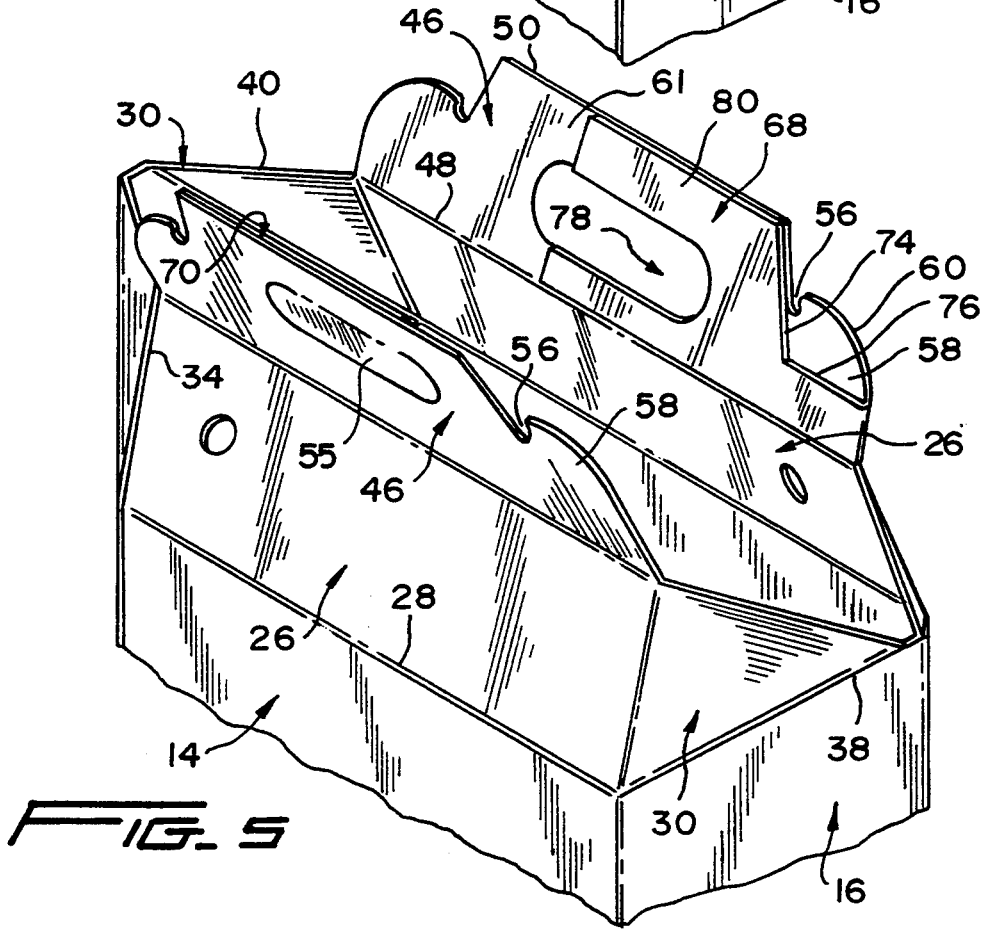
FIG. 5 illustrates the carton formed and the initial step in closing the carton with the reinforcement panels in position.

Referring now more specifically to the drawings, the carton 10, and hence the blank 12 of paperboard or the like from which it is formed, includes two side walls 14 and two end walls 16 integrally joined in the blank along fold lines 18. The side walls 14 are normally relatively longer than the end walls 16. The walls are folded and joined to define the internal carton compartment utilizing a foldable glue flap 20 along the free side edge of the endmost side wall 14 which affixes, through appropriate adhesive means 21, along the free edge portion of the endmost end wall 16.

The bottom of the carton is defined by overlapping and bonding side and end bottom flaps 22 and 24 respectively.

A closure panel 26 is coextensive with each side wall 14 and integral with the upper edge 28 thereof along a defined fold line also designated as 28.

An end panel 30 is integral with the upper edge 32 of each end wall 16 along a fold line defined thereat, similar fold lines 34 being defined between the adjoining side edges of the end panels 30 and adjacent closure panels 26.

In the carton, after formation of the compartment and prior to a closing thereof, the endmost closure panel 26 is adhesively secured to the free outer edge portion of the endmost end panel 30 by an appropriate glue flap 36.

Each of the end panels 30 include a pair of fold lines 38 extending diagonally from the opposed lower corners thereof at the end wall upper edge or fold line 32 to the center point of the free upper or outer edge 40 of the end panel 30. Further, each end panel 30 includes a vertical slot 42 centrally therein and for a major portion of the height thereof commencing at approximately the fold line 32. The slot 42 will preferably include, at mid-height therein, a pair of opposed enlargements to define a generally circular enlarged aperture 44.

An elongate handle panel 46 is coextensive with each closure panel 26 and integrally formed along a fold line defined by the upper or outer edge 48 of the closure panel 26. Each handle panel 46 has a free outer edge 50 paralleling or substantially paralleling the fold line 48. In addition, each handle panel 46 includes opposed side edges 52 and 54 aligned with the side edges of the closure and end panels 26 and 30 therebelow or inward thereof.

The free outer edge 50 of each handle panel 46 terminates short of the opposed edges 52 and 54 and is inwardly offset to define, toward each side of the corresponding handle panel 46, an upwardly opening retaining notch 56 with an upwardly directed tongue or lug 58 immediately laterally outward thereof and provided with an arcing upper edge 60 between the corresponding side 52 or 54, and the slot 56.

Each of the handle panels further includes an elongate flap 55 approximately midway between the outer edge 50 and the fold line 48. Each flap is pivoted about the upper elongate edge 57 thereof to swing laterally from the corresponding handle panel 46 and define an opening or aperture 59 with the handle panel portion overlying each aperture or opening 59 defining the actual hand grip portion 61.

Figure 7:
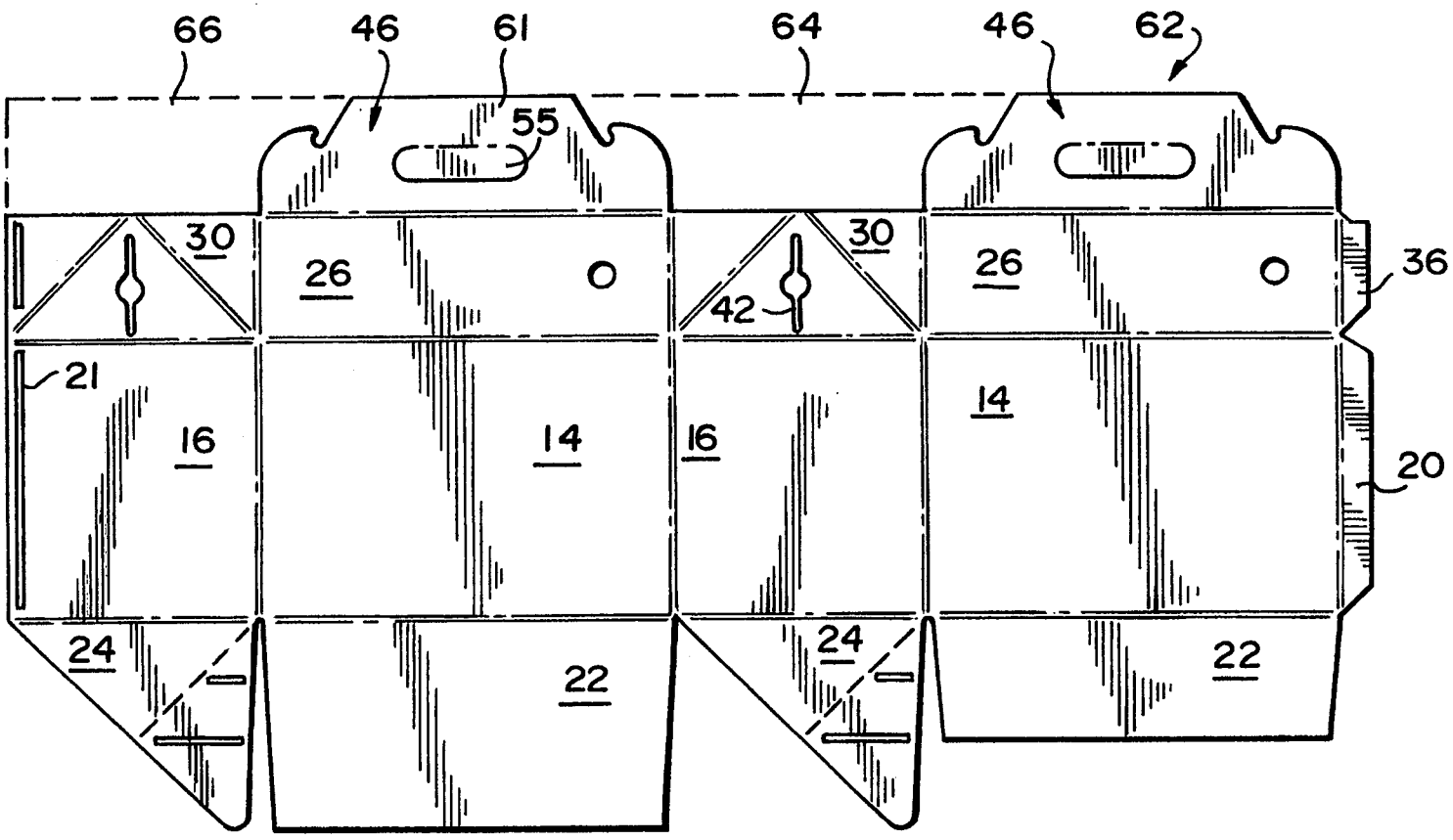
FIG. 7 (PRIOR ART)
FIG. 7 illustrates the prior art carton blank.

Noting FIG. 7, the above described structure is substantially that known in the prior art blank 62, wherein like reference numerals have been applied to like parts. This prior art blank of FIG. 7 leaves two substantial areas of scrap material, 64 between the two handle panels 46, and 66 to one side of one of the handle panels 46 and overlying the endmost end panel 30.

The folding of the prior art blank into a finished carton will be readily apparent from the sequence of steps which illustrate the folding of the improved blank of the present invention, with the resultant prior art folded carton providing a handle thickness of only two handle panels secured principally by the folded end panels 30 engaged with the handle panel slots 56 and tongues 58.

The present invention substantially enhances the strength of the carton 10, and in particular the handle thereof, by utilizing these normally removed scrap areas 64 and 66 to form a pair of cooperating reinforcing or reinforcement panels 68 and 70. Each of these reinforcement panels 68, 70 is of equal length with the end panel 30 immediately therebelow or inward thereof, and of substantially equal height with the adjoining handle panels 46, thus taking full advantage of the scrap areas which were heretofore merely discarded. Each reinforcement panel 68, 70 is free of the upper or outer edge 40 of the end panel 30 immediately therebelow, a cutline being formed therealong in the blank 12. Further, each reinforcement panel 68, 70 is secured only to an adjacent edge 54 of an adjacent handle panel 46 with a fold line being defined along this edge 54. As will be appreciated, the reinforcement panels 68, 70 are joined to the corresponding or same side edges 54 of the two handle panels 46. The height of each of the reinforcement panels 68, 70 at the joined edge 54 is equal to that of the edge 54 up to the corresponding outer edge arc 60, providing in effect a straight fold line for proper folding of the reinforcement panel 68, 70 as shall be described subsequently.

The upper or outer edge 72 of each reinforcement panel 68, 70 is generally aligned or linear with the upper or outer edges 50 of the handle panels 46 and, toward the side thereof corresponding to the fold line side edge 54, is stepped downward to define an inclined edge 74 and an extension 76 parallel to the upper portion of the outer edge 72 whereby, upon a folding of the reinforcement panels 68, 70 about the fold lines to overlie the adjacent handle panels 46, the locking notches 56 will remain fully exposed.

Each reinforcement panel 68, 70, along the side edge thereof opposite from the secured side edge, is free and includes, at generally mid-height, a longitudinally inwardly directed opening 78 which in turn defines an elongate grip portion 80 thereabove. As will be noted, the grip portion 80 on the reinforcement panel 68 between the two handle panels 46 is slightly longer than the other grip portion 80 on reinforcement panel 70 in that it extends to the arcing edge 60 of the adjacent handle panel 46, thus maximizing use of the scrap area.

The configuration and positioning of the openings 78 within the reinforcement panels 68, 70 is such as to directly overlie the openings 59 in the handle panels 46 which define the hand hole in the completed closed carton 10.

As noted in the sequence of drawings of FIGS. 4, 5, 6 and 1 illustrating various stages of the folding of the blank into the carton, the reinforcement panels 68, 70 fold between the grip portions 61 of the handle panels 46 with the grip-forming portions 80 of the reinforcement panels 68, 70 either centrally meeting or preferably slightly overlapping to provide for full length rigidification of the handle grip. At the same time, the side portion of each reinforcement panel 68, 70, that is that portion beyond the end of the hole or recess 78 therein, provides for a positive reinforcement of the two sides of the overlapped handle panels 46, an area of maximum stress.

When the erected carton 10 of the invention is to be closed, as an initial step the reinforcement panels 68, 70 will be folded to lie immediately inside of the corresponding handle panels 46 and bond thereto by appropriate adhesive means 82. The closure panels 26 are then brought into closed position and the handle panels 46 engaged with the reinforcement panels 68, 70 therebetween. The closure panels 26 and handle panels 46 are locked into position by the folded end panels 30 and further secured, as desired, by hand hole flaps 55 retained, along upper fold lines 57, on the two handle panels 46 as the original openings therein are defined. In this manner, the strength of the carton of the invention is greatly enhanced with substantially no change in the appearance thereof and with little or no additional expense or consumption of time in light of the use of what would normally be scrap areas. While an adhesive bonding of the panels 68 and 70 is preferred, other securing means can be used, for example reliance solely on a folding flap 55.

The foregoing is illustrative of the preferred embodiment of the invention. As variations may occur to those skilled in the art, it is to be appreciated that the invention is to be limited only by the claims following hereinafter.

For purposes of illustration, the blank has been generally described and claimed as positioned vertically with the handle components uppermost to conform to an erected carton.

I claim:

1. In a carton having a bottom and peripheral walls extending upwardly from said bottom and defining an interior, said walls comprising opposed side walls and opposed end walls, each said side wall terminating in a side upper edge, each said end wall terminating in an end upper edge; a folding closure assembly, said closure assembly comprising a pair of side closure panels, one integral with each said side upper edge along a fold line for inward folding to overlie said interior, said side closure panels each having an outer edge, a pair of handle panels one integral with said outer edge of each said side closure panel along a fold line for an outward folding thereof to extend upward from said side closure panels to overlie each other and define a handle upon an inward folding of said side closure panels, each said handle panel having an outer edge and having a hand hole defined through said handle panel between said handle panel outer edge and the corresponding side closure panel, a hand grip portion between said hand hole and said handle panel outer edge of each said handle panel, said handle panels each having opposed ends, a handle reinforcement panel integral with one said end of each said handle panel along a fold line for inward folding to overlie the handle panel integral therewith, each said reinforcement panel upon inward folding, overlying said respective integral handle panel between the respective fold line therebetween and the respective hand hole, and also at least partially along said hand grip portion of said integral handle panel, said reinforcement panels being folded between and confined between said handle panels upon a folding of said handle panels to define a handle, said reinforcement panels extending toward each other from respective ends of said handle panels, and combining to extend full length of said hand grip portions, each said reinforcement panel having an opening therein conforming to a portion of the hand hole of the handle panel integral with the respective reinforcement panel, and end panels integral with said upper edges of said end walls along fold lines, said reinforcement panels being positioned one immediately outward of each said end panel and foldable independently thereof.

2. The carton of claim 1 including interlocking means on said end panels and said handle panels for locking said handle panels in the folded position thereof with the reinforcement panels therebetween.

3. The carton of claim 2 wherein said side closure panels each have opposed ends, said closure panels and said handle panels being of substantially equal length.

4. The carton of claim 3 wherein said reinforcement panels each having an outer end remote from the respective integral handle panel, and being of a length from said respective integral handle panel to said respective outer end greater than one-half the length of the respective integral handle panel.

5. The carton of claim 4 wherein said closure panels and end panels are of substantially equal width outward from said wall upper edges.

6. In a formation of a carton having a bottom and peripheral walls, a closure and a handle; a blank including a pair of side walls and a pair of end walls alternating with said side walls and integral therewith along fold lines therebetween, each said side wall terminating in a side upper edge, each said end wall terminating in an end upper edge, a closure assembly, said closure assembly comprising a pair of side closure panels, one integral with each said side upper edge along a fold line for inward folding, said side closure panels each having an upper edge, a pair of handle panels, one integral with said upper edge of each said side closure panel along a fold line for an outward folding thereof to extend upward from said side closure panels to overlie each other and define a handle upon an inward folding of said side closure panels, each said handle panel having an upper edge and having a hand hole defined through said handle panel between said handle panel upper edge and the corresponding side closure panel, a hand grip portion between said hand hole and said respective handle panel upper edge of each said handle panel, said handle panels each having opposed ends, end panels integral with said upper edges of said end walls along fold lines, and handle reinforcement panels positioned one immediately upward of each said end panel and foldable independently thereof, said handle reinforcement panels being integral with separate ones of said ends of said handle panels along respective fold lines for inward folding of each said reinforcement panel to overlie the handle panel integral therewith, one of said reinforcement panels being laterally between said handle panels, and another of said reinforcement panels being laterally outward of one of said handle panels.

7. The blank of claim 6 wherein said reinforcement panels extend away from the respective handle panels in the same direction.

8. The blank of claim 7 wherein each said reinforcement panel has a recess therein conforming to a portion of the hand hole of the handle panel integral with the respective reinforcement panel.

9. In a carton having a bottom and peripheral walls extending upwardly from said bottom and defining an interior, said walls comprising opposed side walls and opposed end walls, each said side wall terminating in a side upper edge, each said end wall terminating in an end upper edge; a folding closure assembly, said closure assembly comprising a pair of side closure panels, one integral with each said side upper edge along a fold line for inward folding to overlie said interior, said side closure panels each having an outer edge, a pair of handle panels one integral with said outer edge of each said side closure panel along a fold line for an outward folding thereof to extend upward from said side closure panels to overlie each other and define a handle upon an inward folding of said side closure panels, each said handle panel having an outer edge and having a hand hole defined through said handle panel between said handle panel outer edge and the corresponding side closure panel, a hand grip portion between said hand hole and said handle panel outer edge of each said handle panel, said handle panels each having opposed ends, a pair of handle reinforcement panels, one said handle reinforcement panel being integral with one said end of each said handle panel along a respective fold line for inward folding to overlie the handle panel integral therewith, each said reinforcement panel upon inward folding, overlying said respective integral handle panel between the respective fold line therebetween and the respective hand hole, and also at least partially along said hand grip portion of said integral handle panel, said reinforcement panels being folded between and confined between said handle panels upon a folding of said handle panels to define a handle, said reinforcement panels extending toward each other from respective ends of said handle panels, each said reinforcement panel having a recess therein conforming to a portion of the hand hole of the handle panel integral with the respective reinforcement panel, and end panels integral with said upper edges of said end walls along fold lines, said reinforcement panels being positioned one immediately outward of each said end panel and foldable independently thereof.

10. The carton of claim 9 wherein each said handle panel, adjacent each said end thereof, includes an upwardly directed locking lug and locking notch formed thereby, said lug and notch being engaged upwardly through a corresponding slot in a respective one of said end panels, each of said handle reinforcement panels, adjacent the respective integral said end of the respective handle panel, having an upper edge portion below the respective locking lug and locking notch for free access thereto by the respective locking slot.

11. The carton of claim 10 including means for bonding each said reinforcement panel directly to said respective handle panel.

12. In a formation of a carton having a bottom and peripheral walls, a closure and a handle; a blank having a free upper edge, a free lower edge, and inner and outer faces, said blank including a pair of side walls vertical relative to said free upper edge, and a pair of end walls vertical relative to said free upper edge and alternating with said side walls and integral therewith along respective parallel vertical fold lines, one said fold line between each said side wall and each said end wall alternating therewith, each said side wall terminating in a side wall upper edge, each said end wall terminating in an end wall upper edge, a closure assembly, said closure assembly comprising a pair of side closure panels, one integral with each said side wall upper edge along a horizontal fold line perpendicular to said vertical fold lines for inward folding, said side closure panels each having an upper edge, a pair of handle panels, one integral with said upper edge of each said side closure panel along a horizontal fold line for an outward folding thereof to extend upward from said side closure panels to overlie each other and define a handle upon an inward folding of said side closure panels, each said handle panel having an upper edge defined by said blank free upper edge and having a hand hole defined through said handle panel between said handle panel upper edge and the corresponding side closure panel, a hand grip portion between said hand hole and said respective handle panel upper edge of each said handle panel, said handle panels each having opposed ends, a pair of handle reinforcement panels each integral with a different one of said ends of said handle panels along a respective vertical fold line for inward folding of each said handle reinforcement panel to overlie the respective handle panel integral therewith, and end panels integral with respective ones of said upper edges of said end walls along horizontal fold lines, said reinforcement panels being positioned one immediately upward of each said end panel and foldable independently thereof.

13. The blank of claim 12 wherein each said handle panel, adjacent each said end thereof, is formed with an upwardly directed locking lug and locking notch formed thereby, each of said end panels having a vertical slot defined therein for cooperative downward engagement with a respective locking lug and locking slot, each said reinforcement panel, adjacent said respective integral end of said respective handle panel, including an upper edge portion, defined by said blank free upper edge, below said locking lug and locking notch adjacent said respective end of said respective handle panel to underlie said respective locking lug and locking notch upon inward folding of said respective reinforcement panels to overlie the respective handle panels to preclude interference with engagement of said locking slots with the respective locking lugs and locking slots.

14. The blank of claim 13 wherein each said reinforcement panel has a recess therein conforming to a portion of the hand hole of the handle panel integral with the respective reinforcement panel.

15. The blank of claim 14 wherein said reinforcement panels extend away from the respective integral ends of said handle panels in the same direction.

* * * * *